United States Patent [19]

Tansill

[11] 4,128,951

[45] Dec. 12, 1978

[54] CUSTOM-FORMED INSERT

[75] Inventor: Horace A. Tansill, Santa Barbara, Calif.

[73] Assignee: Falk Construction, Inc., Santa Barbara, Calif.

[21] Appl. No.: 665,805

[22] Filed: Mar. 11, 1976

Related U.S. Application Data

[63] Continuation of Ser. No. 575,416, May 7, 1975, abandoned.

[51] Int. Cl.[2] ..... A43B 7/14; A43B 13/38; A43B 19/00

[52] U.S. Cl. ..... 36/44; 36/71; 36/88

[58] Field of Search ..... 36/71, 88, 89, 90, 91, 36/92, 93, 44, 28, 29; 12/146 R

[56] References Cited

U.S. PATENT DOCUMENTS

| | | | |
|---|---|---|---|
| 3,417,494 | 12/1968 | Claff | 36/44 |
| 3,641,688 | 2/1972 | von den Benken | 36/88 |
| 3,736,673 | 6/1973 | Dubner | 36/44 |

*Primary Examiner*—Patrick D. Lawson

[57] ABSTRACT

A construction and method of forming shoe inserts in order to support the arch of the entire foot, in which a flexible container is filled with a formable material that is capable of curing at about room temperature to form an elastomeric material, the container is placed inside the shoe beneath the foot, and pressure is maintained on the foot while the formable material sets and hardens.

The formable material may be provided by means of a catalyst-filled inner container with frangible walls which can be ruptured by applying pressure to the outer container, thereby to admix the catalyst with a curable elastomeric material which fills the rest of the outer container's volume.

4 Claims, 16 Drawing Figures

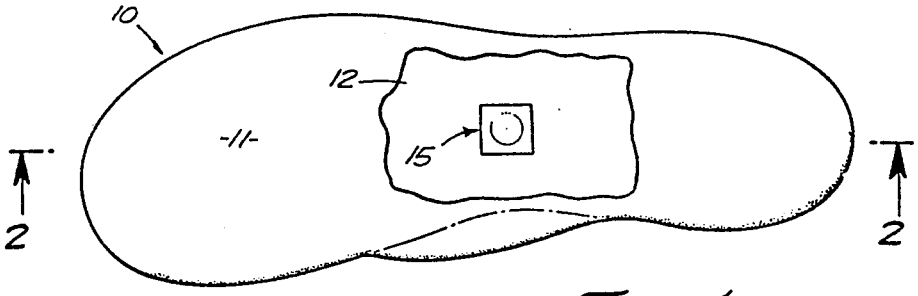
FIG. 1.
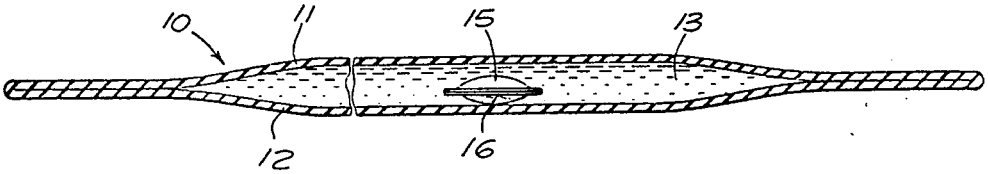
FIG. 2.
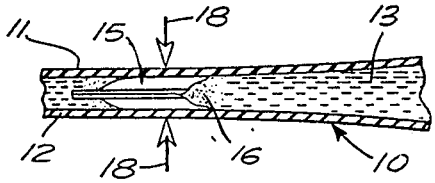
FIG. 3.
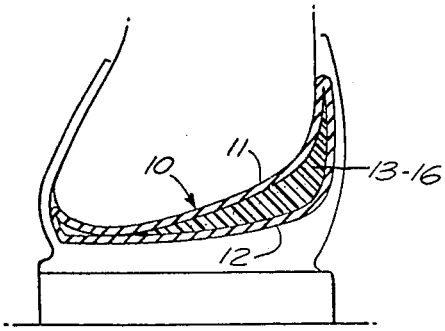
FIG. 4
FIG. 5.
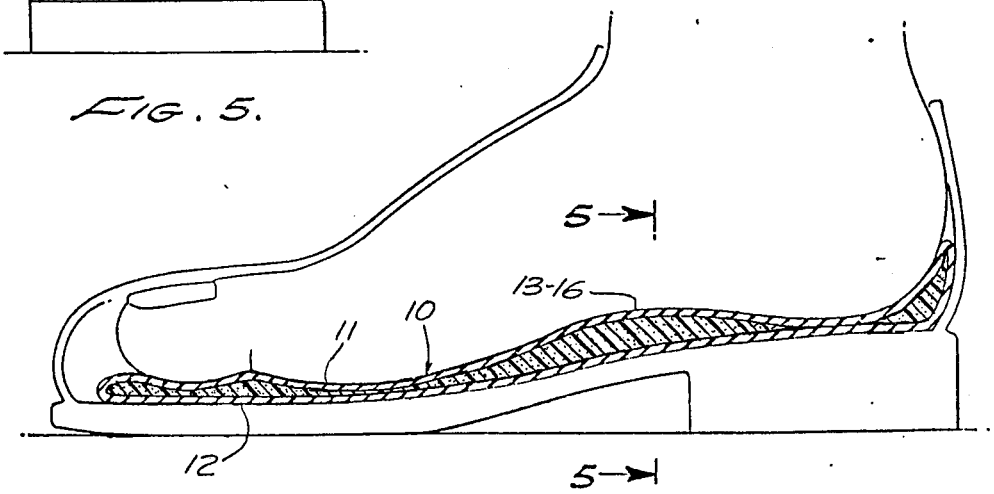

7
34
31
22
P
20
21
51
25
V
27
41
33
32
54
55
56
58
53
52
57
44
8
42
49
43
45
48
10

12
39
P'
32
31
30
G
V'
37
12
G
P'
V'
32
13
37
V'
13

32
31
30

31

32
15
16
16
31
30

15

CUSTOM-FORMED INSERT

This is a continuation, of application Ser. No. 575,416, filed May 7, 1975, and now abandoned.

BACKGROUND OF THE INVENTION

The use of removable arch supports in shoes is well-known. Such arch supports are manufactured in standard sizes and shapes, typically by using several layers of leather and selecting each piece of leather as to size and configuration so that the composite structure assumes the desired shape.

Custom-made arch supports that are removable from the shoes are also well-known. A measurement technique is employed, such as by making an impression of the bottom of the foot and then fabricating the arch support accordingly.

All of the arch supports heretofore available here, however, left much to be desired. The ready-made products generally do not fit very well, while the custom-made products involve a great deal of difficulty, time, and expense in completing their fabrication.

The object and purpose of the present invention is to provide custom-made shoe inserts and a method for preparing them, which will achieve a high degree of comfort for the wearer and will at the same time involve a minimum of time and expense in their fabrication.

SUMMARY OF THE INVENTION

In accordance with the present invention a container having flexible upper and lower walls is filled with a formable material that is capable of curing at about room temperature to form an elastomeric material, and the container is inserted in the shoe beneath the bottom of the foot. Pressure is applied downwards on the foot while the formable material is curing. The end result is a shoe insert whose upper surface precisely fits the bottom of the foot of the wearer, while its lower surface precisely fits the inner shoe surface.

Generally, the invention comprises the provision of a preformed prosthetic blank which is at least substantially closed and the walls of which are composed generally of flexible barriers. The prosthetic blank is configured in the form of a blank unformed arch support and is adapted to be inserted in a shoe and subjected to an in situ molding process for the purpose of producing a prosthetic foot device in situ. The structural shape of the prosthetic foot device is determined by providing within the interior of the prosthetic blank a curable but initially moldable material.

In one form the material which is to be cured to provide the necessary resilient structural rigidity for the prosthetic device is incorporated within the prosthetic blank at the time of manufacture. In the configuration where the prosthetic blank, as supplied to the customer, contains moldable material within it, there is generally included within the closed walls of the prosthetic blank both a polymerizable pre-elastomeric material and a catalyst or cross-linking agent as well as other conventional materials such as, for example, fillers, foaming agents, and the like. The catalyst or cross-linking agent is separated from the polymeric material by a barrier which is easily broken through suitable manipulation of the prosthetic blank to initiate a polymerization reaction.

In the configuration where the prosthetic blank contains no polymeric or prepolymeric material, as supplied to the customer, provisions are made for injecting this material into the prosthetic blank at the time of use. The prosthetic blank must first be evacuated so as to remove any air bubbles from within the interior of the closed prosthetic blank. Evacuation is followed by the introduction of a suitable premixed polymeric admixture which then polymerizes in situ. In situ molding is accomplished by inserting the prosthetic blank into a preselected shoe. The intended wearer of the shoe then inserts his foot into the shoe on top of the prosthetic blank. The polymerizable reaction admixture which is provided in the prosthetic blank is allowed to polymerize while the wearer of the shoe applies pressure on the prosthetic device by standing or by pressing his foot against an appropriate surface.

The cured final shape of the prosthetic device is determined in some substantial part by the amount of pressure applied during the in situ molding, with the arch being depressed to a flatter profile by increasing the pressure on the prosthetic device during the molding operation. The molding is continued for a period of time sufficient to permit the polymerizable reaction admixture to set to a resiliently rigid condition such that changes or alteration in pressure will not substantially alter its shape.

Curing should be accomplished at approximately room temperature, or in any event at a temperature no higher than normal body temperature, so that the wearer of the shoe will not experience any discomfort during the molding process. Also the nature of the polymerizable admixture should be such that it does not generate a great deal of exothermic heat during the polymerization reaction. Suitable polymerizable reaction admixtures are well-known and include for example, silicone rubber forming admixtures, and the like.

When the procedure is followed where the prosthetic blank is first evacuated and then the curable admixture is injected into the void defined by the walls of the prosthetic blank, suitable equipment is provided which preferably accomplishes both the evacuation and the injection without subjecting the wearer of the shoe to long delays. A product resulting from this in situ molding process is a custom made prosthetic foot device which is precisely contoured to the upper surface of the individual shoe's sole and the bottom of the individual wearer's foot.

According to one mode of practicing the invention, the flexible container is evacuated and filled with formable material and is sealed before being inserted into the shoe. A downward pressure on the foot, preferably of a constant value, is maintained while the formable material is curing. The shoe insert is then complete and ready for use. According to this first mode of practicing the invention, the amount of formable material that is contained inside the flexible container has to be determined or selected before actually fitting the shoe insert to the foot and shoe of the wearer. The selection process may be accomplished in two different ways.

One way is to choose an empty container having an opening, make a measurement from the foot and the shoe of the customer to determine the amount of filler material that is needed, and then after evacuating air to insert this amount of material into the container and close and seal the container.

Another way of achieving the desired result is to prepare ready-made containers each of which has a predetermined amount of filler material inside. A particular container to be used for a particular customer may then be selected on the basis of the size and shape of the container and the quantity of filler material which it contains. Where ready-made containers are being used, it is necessary to control the initiation of the curing of the filler material. A filler material may be used which is normally in a liquid state but when exposed to a catalyst will cure to a resilient permanent state. The quantity of catalyst that is needed may be quite small. The catalyst is placed inside a bulb, or inner container, that is of frangible construction. Prior to placing a shoe insert inside the shoe it is then necessary to exert pressure on the flexible container at the spot where the bulb or inner container is located, in order to fracture the bulb and thereby release the catalyst, and then the container is kneaded to intimately mix the catalyst and filler materials.

According to a second mode of practicing the invention the evacuated empty container is filled at the same time it is being fitted to the foot. The empty container is placed within the shoe beneath the foot of the wearer or customer. Then an appropriate amount of formable material is inserted through the opening into the interior of the container. Sufficient pressure is placed on the formable material to fill the container. As before, pressure is then maintained on the foot until the formable material has cured.

DRAWING SUMMARY

FIG. 1 is a top plan view of a ready-made shoe insert in accordance with the present invention;

FIG. 2 is a longitudinal cross-sectional view of the shoe insert of FIG. 1;

FIG. 3 is a fragmentary cross-sectional view of the shoe insert of FIG. 1;

FIG. 4 is an elevational view, partially in cross-section, showing the insert in its operative position between the foot and the shoe of the wearer;

FIG. 5 is a transverse cross-sectional view taken on the line 5—5 of FIG. 4;

READY MADE SHOE INSERT

Figures 6, 7, 8, 9, 10:
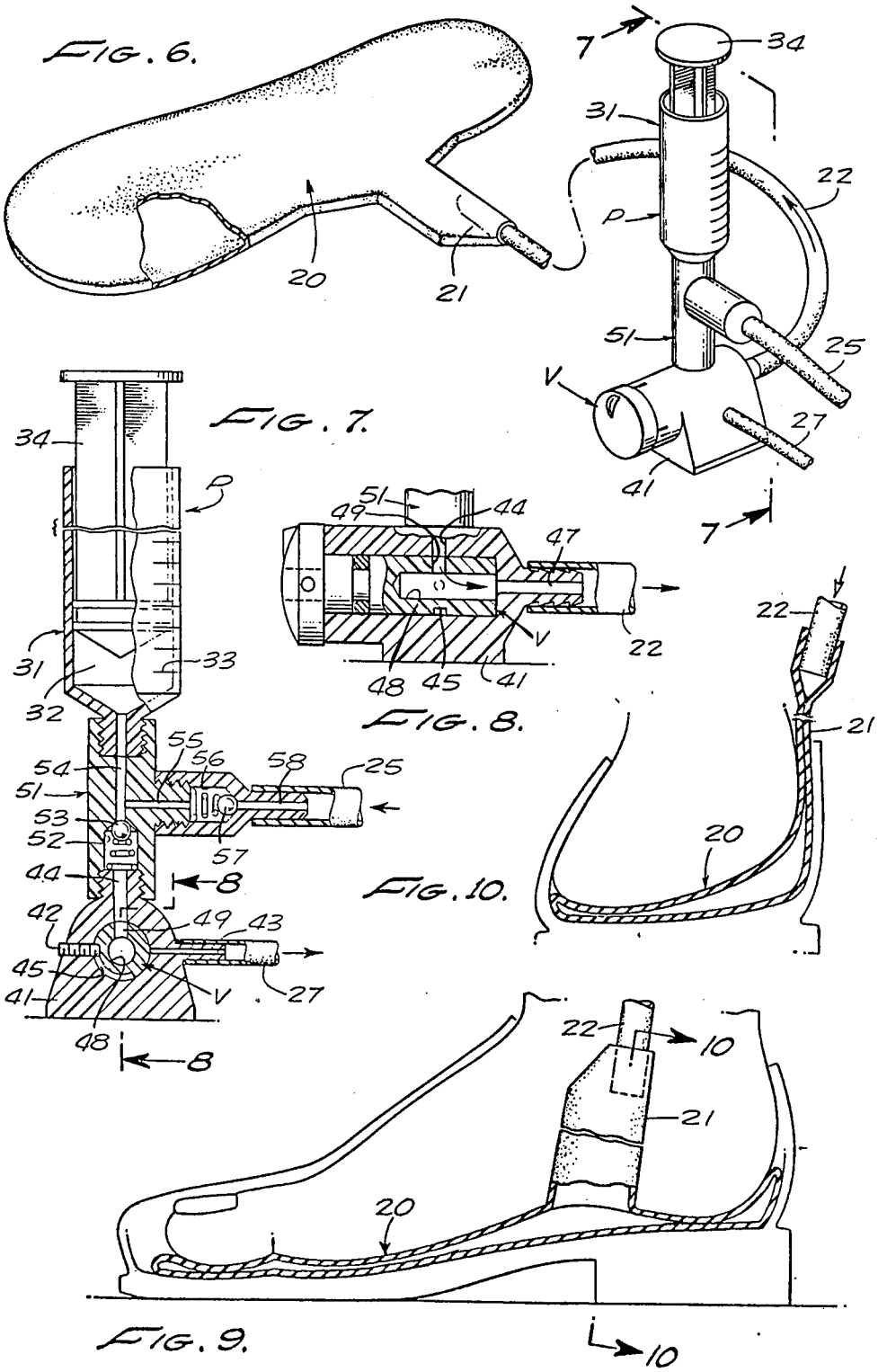
FIG. 6 is a perspective view of a measuring apparatus provided in accordance with the present invention.
FIG. 7 is a cross-sectional elevational view taken on the line 7—7 of FIG. 6.
FIG. 8 is a fragmentary cross-sectional view taken on the line 8—8 of FIG. 7.
FIG. 9 is an elevation view, partially in cross-section, of the foot and shoe of the wearer when the measuring apparatus of FIG. 6 is being used.
FIG. 10 is a transverse cross-sectional view taken on line 10—10 of FIG. 9.

Reference is now made to FIGS. 1 through 5, inclusive, illustrating a ready-made shoe insert in accordance with the invention, and the manner in which it is used.

A flexible container 10 has an upper wall 11 and a lower wall 12. The walls 11 and 12 are generally parallel to each other; more specifically, however, the upper wall 11 is adapted to approximately conform to the bottom of the foot of the wearer or customer, while the lower wall 12 is adapted to approximately conform to the inner surface of the shoe. Container 10 is filled with a liquid material 13 which constitutes one of the components of a thermosetting elastomeric material. Such materials are well-known and include, for example, polyesters, polyurethanes, and the like. Inside the container 10 there is a bulb or inner container 15, which is of relatively small size compared to the container 10. The bulb or inner container 15 is frangible, that is, it is easily fractured or ruptured in response to the application of pressure. Contained within the bulb 15 is a liquid material 16 which is the second component of the elastomeric material. In chemical terms the liquid material 16 might, therefore, be identified as the catalyst.

Prior to placing container 10 inside the shoe of the wearer it is necessary to rupture the bulb or inner container 15. This is accomplished by applying pressure to both the upper wall 11 and the lower wall 12 of the container 10, as indicated in FIG. 3 by the arrows 18. The result is that bulb or inner container 15 is ruptured and the liquid material 16 is dispersed outward into the liquid material 13.

The next step is to perform a mixing or kneading operation which may be accomplished by shaking, twisting, and otherwise manipulating the container 10.

Container 10 is then placed inside the customer's shoe and the customer puts his foot in the shoe as shown in FIG. 4. A downward pressure is applied to the customer's foot while the formable material, now identified by numeral 13–16 to indicate both of its components, completes its setting and curing. The amount of weight applied to the foot is preferably maintained at a constant level. It is preferred to utilize a weighing scale, or some other convenient type of auxiliary apparatus, in order to insure that the correct amount of downward force is exerted on the foot and also in order to insure that the amount of downward force is relatively constant while the formable material is setting. Then the device is ready for use by the customer.

The shoe insert as illustrated in FIG. 1 through 5, inclusive, is of such size as to fit beneath the entire length of the customer's foot and fill almost the entire length of the shoe. However, essentially the same device may be made in a much smaller configuration so that it fits only into the area beneath the arch of the foot. The method of constructing the device, and the method of using it, are essentially the same in either application.

Container 10 may be integrally formed from a single material, or the upper and lower walls may be formed of different materials and adhesively secured around their peripheral edge.

MEASURING APPARATUS

Reference is now made to the drawings, FIGS. 6 through 10, inclusive, which illustrate a measuring apparatus provided in accordance with the present invention.

A flexible container 20, best shown in FIG. 6, is used for measuring the volume or quantity of the filler material that should be used in order to fit the foot of a particular customer with the greatest degree of comfort. Container 20 may, for example, be of the same size and configuration as container 10, so that the volume measurement made by utilizing container 20 and its associated apparatus will directly and precisely indicate the volume or quantity of filler material that should be utilized in the container 10. Alternatively, a single container may first be used for measuring, then evacuated and filled with formable material to provide the shoe insert.

Container 20 also has a laterally projecting portion 21 which protrudes laterally outward from the instep portion of the container. A flexible tube 22 is attached to the container extension portion 21.

A pump P controlled by a valve V is utilized for supplying an incompressible liquid through the tube 22 in order to fill the container 20. The volume measurement is made by utilizing a scale 33 provided on the pump. After the measurement has been made the liquid which filled the flexible container 20 is carried away through a vacuum line 27. A supply line 25 is then utilized for refilling the chamber 32 of pump P to its normal level.

More specifically, flexible container 20 is placed in the shoe of the customer, and the customer is instructed to place the bottom of his foot on top of the container 20 and to press his foot downward. It is preferred to maintain a constant weight on the foot, and a scale or other instrument may be utilized in order to achieve this result. Pump P is then employed to fill the container 20 so that its upper surface is in intimate contact with the bottom of the foot while its lower surface is in intimate contact with the inner bottom surface of the shoe. A reading on the scale 33 is then taken.

The selection of weight value applied on the customer's foot during the fitting process is most important. If a heavy weight is applied, such as the total weight of the person, the arch of the foot is greatly deflected downward. As a result the volume of filler material required in the insert will be at a minimum, and the supporting action which the shoe insert provides to the arch during normal walking and standing will be at a corresponding minumum. On the other hand, if minimum weight is applied to the foot during fitting, such as one-fourth of the weight of the person, then the amount of filler material required in the shoe insert will be at a maximum. The reason is that the space between shoe and foot is greater. The shoe insert when completed will then provide a corresponding maximum amount of support to the arch of the foot. The selected weight value should be held constant when measuring the required volume of the filler material, and again held constant at the same value when the ready-made shoe insert is being completed by curing the filler material.

The base 41 has a cylindrical chamber which receives the rotary valve V. The external surface of valve V has an annular groove 45 extending somewhat more than 90°, which receives a screw 42 in order to limit the rotary movement of valve V to a quarter circle. Valve V has a longitudinal central opening 48 which always communicates through a passageway 47 (FIG. 8) with the tube 22. It also has a lateral or vertical opening 49 which has two alternate positions corresponding to the extreme rotary positions of the valve. In the position of valve V as shown in FIGS. 7 and 8 the valve passageway 49 communicates with a vertical passageway 44 in the housing 41. Passageway 44 communicates with a chamber 52 in the lower end of tubular member 51, and a ball type check valve 52 is urged by a spring toward the upper end of chamber 52. Chamber 52, except when closed by valve 53, communicates through a vertical passageway 54 with the pump chamber 32. Pump P has a plunger 34 which is movable vertically relative to the pump housing 31.

It is assumed that initially the chamber 32 of the pump P is full of liquid. The operation of filling the container 20 and measuring its volume, takes place as follows:

Plunger 34 is moved downward which causes valve 53 to open. Liquid flows from chamber 32 through passageway 54 and chamber 52 into the passageway 44. From there it flows into the valve passage 49 and out the valve passage 48 through passage 47 into tube 22. When the flexible container walls are in intimate contact with both foot and shoe, a reading is taken on the scale 33 of pump P. This intimate contact generally occurs within a pressure range of about one to ten inches of water, and it is preferred to establish this pressure level by means of an automatic pressure regulator, not specifically shown.

In order to evacuate the container 20, the valve V is rotated to its alternate position. Valve passage 49 then communicates through passage 43 (FIG. 7) with the vacuum line 27. The contents of container 20 are then withdrawn through the vacuum line 27.

While keeping valve V in its rotated or alternate position as just described, the pump may be refilled. Tubular member 51 has a horizontal passageway 55 which communicates with vertical passageway 54. A chamber 56 is formed at the outer end of passageway 55. A passageway 58 communicates between chamber 56 and the refill tube 25. A ball-shaped valve 57 is supported in chamber 56 and normally closes the passageway 58. As the plunger 34 of pump P is raised, however, check valve 57 opens and liquid is drawn from the tube 25 through passageways 58, 56, 55 and 54 into the pump chamber 32.

CUSTOM-FILLED INSERT

Reference is now made to the drawings, FIGS. 11 through 16, inclusive, illustrating a custom-filled insert provided in accordance with the present invention.

A flexible container 30 has generally the same configuration as has been shown by the containers 10 and 20. Container 30 is to be filled with a formable material capable of curing to a resilient state. Pump P' contains a quantity of the pre-catalyzed material in liquid form. A tube 32 couples pump P' to the resilient container 30, and the operation of the pump is controlled by a valve V'.

Container 30 is placed inside the shoe of the customer. The downward pressure of the customer's foot is then maintained at a constant level. A scale or other instrumentation may be used in order to achieve this result. Container 30 and tube 32 are evacuated through line 37 by turning valve V' to its alternate position.

Figures 11, 12, 13, 14, 15, 16:
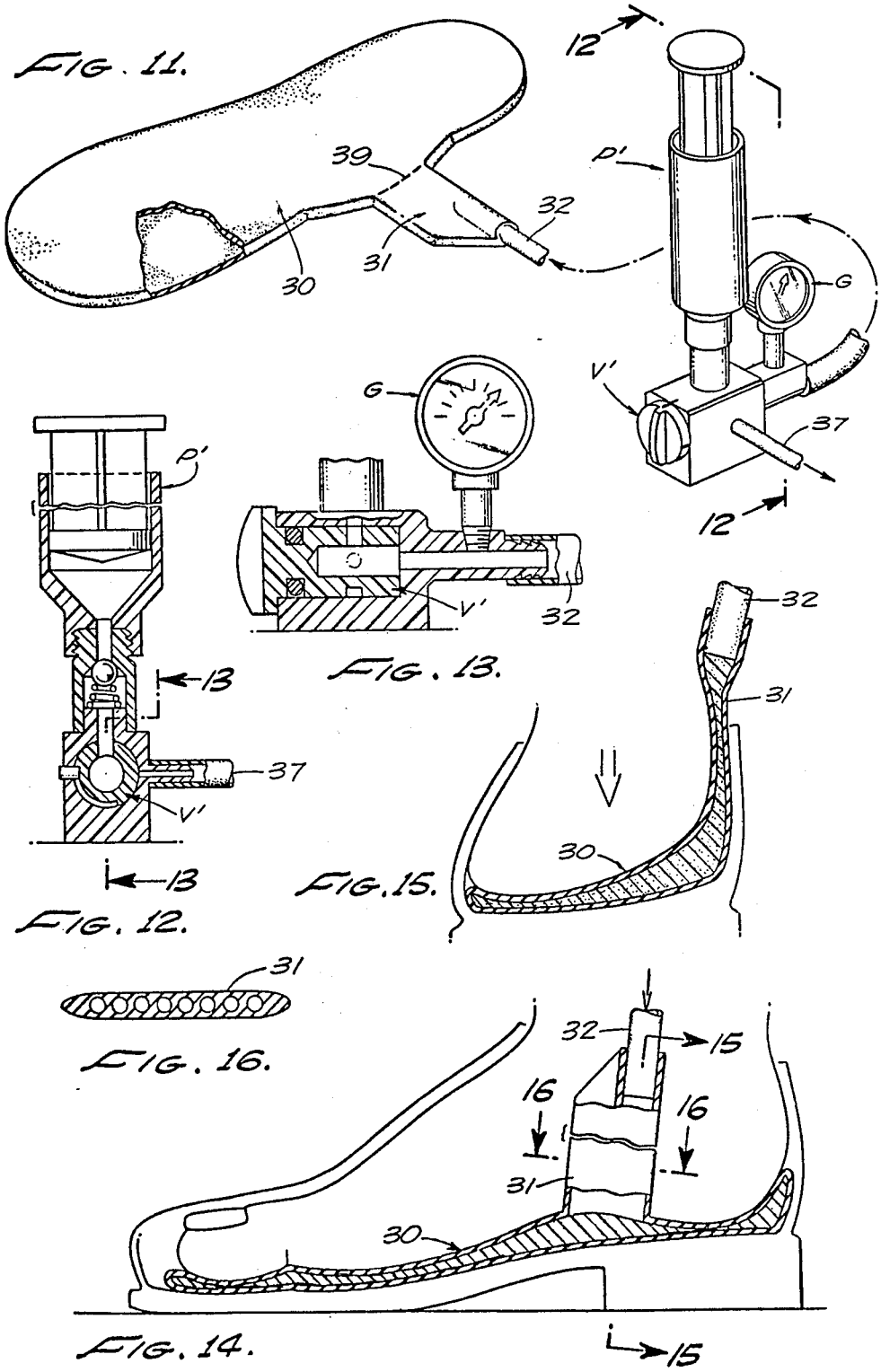
FIG. 11 is a perspective view of a custom-filled shoe insert together with the apparatus for filling it.
FIG. 12 is a cross-sectional elevation view taken on the line 12—12 of FIG. 11.
FIG. 13 is a fragmentary cross-sectional view taken on the line 13—13 of FIG. 12.
FIG. 14 is an elevation view, partially in cross-section, of the insert of FIG. 11 when inserted in the shoe of the wearer.
FIG. 15 is a transverse cross-sectional view taken on the line 15—15 of FIG. 14.
FIG. 16 is a fragmentary cross-sectional view taken on the line 16—16 of FIG. 14.

The valve is then returned to the position shown in FIGS. 12 and 13. The plunger of pump P' is pushed downward in order to fill container 30 with the pre-catalyzed formable material. A gage G coupled in communication with the supply line 32 may advantageously be used to control the level of pressure that is applied to the formable material. Initially the material is quite liquid with a rather low viscosity, and may be injected into the container under a rather low pressure. The material then cures and hardens in about 10 minutes, in a configuration that is determined by the shapes of both the foot and the shoe.

The pressure level as indicated on gage G is significant when container 30 is first being filled, because at this point of time the filler material has a low viscosity and the pressure measurement is quite meaningful. The optimum level of pressure is of the order of one inch of water where both of the container walls are made of highly flexible material. This amount of pressure is then adequate to provide an intimate contact of the upper wall of container 30 with the bottom surface of the foot, and an intimate contact of the lower wall of container 30 with the inner surface of the shoe. If the container 30 is made of material having any degree of stiffness, however, a significantly higher level of pressure may be required.

When the formable material has cured, the insert is removed from the customer's shoe and the lateral protrusion 31 is cut off along the dotted line 39, as shown in FIG. 11. The customer now has a completed shoe insert that is ready for his permanent usage.

The cleaning of pump P' may present a problem because of the curing and consequent hardening of the filler material, however, it is possible to construct the pump from plastic materials which are inexpensive and can be thrown away after a single useage.

Still another variation of the invention provides a custom-filled shoe insert without the necessity of evacuating the flexible container. The bottom wall of the container is made of non-porous material while the upper wall is made of a material which has a certain degree of porosity, such as leather or synthetic leather or the like. The degree of porosity of the material is selected so as to permit entrapped air to escape through it, but not the elastomer. Therefore, when the elastomer is injected into the container the entrapped air is driven out through the pores of the upper wall.

ALTERNATE FORMS

According to the present invention the flexible container 10 or 30 may, if desired, be dismembered and removed so that the cured filler alone may be used as the shoe insert.

According to another variation of the invention a cover member is attached to one surface of the flexible container and becomes a part of the complete shoe insert.

It should be noted that the technique disclosed herein is not limited to shoe inserts but may also be applied to another body member. For instance, it may be applied in fitting a seat cushion of a car to a particular driver.

What is claimed is:

1. A ready-made shoe insert comprising:

an outer container having flexible, generally parallel upper and lower walls;

an inner container whose volume is small compared to the volume of said outer container, disposed within said outer container;

a quantity of curable liquid elastomeric material filling the remaining interior of said outer container;

a quantity of liquid catalyst filling said inner container; and said inner container being frangible whereby said outer container may be compressed in order to rupture said inner container without rupturing said outer container.

2. A shoe insert as in claim 1 wherein said upper wall of said outer container is shaped to approximately conform to the bottom of a person's foot.

3. An initially mobile means adapted to be applied to a surface in conformity thereto, and thereafter rendered relatively immobile, said means comprising:

a. a first container having relatively uniform flexible walls;

b. a second container having a frangible wall exposed to the interior of the first container;

c. a first initially fluid reactant filling the first container and confronting the frangible wall of the second container;

d. a second reactant filling the second container;

e. said first container being initially distortable whereby said frangible wall of said second container may be ruptured, said first container thereupon being manipaltable to distribute said second reactant throughout said first reactant to form upon reaction a relatively immobile product.

4. A means, as defined in claim 3, wherein:

said second container is of small volume with respect to said first container and is fully immersed in said first reactant.

* * * * *